United States Patent [19]

Ogihara et al.

[11] 4,371,267

[45] Feb. 1, 1983

[54] TIME DETECTING DEVICE FOR ALARM CLOCK

[75] Inventors: Masuo Ogihara; Nobuo Shinozaki; Tadashi Ishikawa; Yoichi Seki, all of Shikawatashi, Japan

[73] Assignee: Seiko Koki Kabushiki Kaisha, Japan

[21] Appl. No.: 218,180

[22] Filed: Dec. 19, 1980

[30] Foreign Application Priority Data

Jan. 17, 1980 [JP] Japan ..... 55-3942

[51] Int. Cl.[3] ..... G04B 23/02; G04C 21/16

[52] U.S. Cl. ..... 368/74; 368/254

[58] Field of Search ..... 368/254, 250, 109, 75, 368/74, 73

[56] References Cited

U.S. PATENT DOCUMENTS 4,069,658 1/1978 Ito ..... 368/254

4,212,155 7/1980 Ogihara et al. ..... 368/250

*Primary Examiner*—J. V. Truhe

*Assistant Examiner*—A. Evans

*Attorney, Agent, or Firm*—Robert E. Burns; Emmanuel J. Lobato; Bruce L. Adams

[57] ABSTRACT

In the time detecting device of an alarm clock is provided with an hour gear wheel and an alarm gear wheel, each having an indication hand, engaging with a second hour gear wheel and a second alarm gear wheel respectively. An detecting cam plate is provided so as to be axially shiftable and continuously pushed and turned by the second hour gear wheel. A projection is formed on either the second alarm gear wheel or the detecting cam plate while a hole is formed on the other. When the respective phases of the projection and the hole coincide, the detecting cam plate is allowed to shift to actuate the alarm device.

3 Claims, 4 Drawing Figures

TIME DETECTING DEVICE FOR ALARM CLOCK

BACKGROUND OF THE INVENTION

This invention relates to an alarm time detecting device for an alarm clock, and more specifically relates to improvement of an alarm time detecting mechanism having a hole on either an hour gear wheel or an alarm gear wheel and a projection on the other gear wheel. The mechanism of this type has been disadvantageous in forming thin type alarm clocks requiring a width corresponding to the axial shift of either the hour gear wheel or the alarm gear wheel. Furthermore, when a gear wheel having the hand is involved in the mechanism, the appearance of the alarm clock is spoiled as the hand moves axially and also disadvantageous requiring space for the shift of the hand.

To solve such problem in the conventional mechanism of this type, an alarm time detecting mechanism has been formed between a second hour gear wheel and a second alarm gear wheel engaging with the hour gear wheel and the alarm gear wheel, each having the needle, respectively. However, even in this arrangement, either the second hour gear wheel or the second alarm gear wheel has to be shifted in the axial direction requiring that the thickness of the gear to be engaged with the shifting gear should be increased so that the thickness of the thin type alarm clock has to be disadvantageously increased for a thickness corresponding to the distance of shifting of the gear wheel.

SUMMARY OF THE INVENTION

Accordingly, an object of the present invention is to provide a mechanism which is eliminated of the disadvantages as hereinbefore described and capable of providing a clock of a reduced thickness. Accordingly to the present invention, the object is attained by providing a second hour gear wheel and a second alarm gear wheel engaging with the hour gear wheel and the alarm gear wheel, and a detecting plate (alarm cam plate) coaxial with both second gear wheels, normally pushed and turned by the second hour gear wheel, provided with a projection which drops into a cavity formed on the second alarm gear wheel at alarm time and adapted to be axially shiftable and by disposing the minute gear wheel provided above the hour gear wheel and the detecting plate practically in the same level, and in addition by forming pivots as integral parts on the case of a clock which rotatably supports the gear wheels of the clock and forming bores on the gear wheels for receiving the pivots.

DETAILED DESCRIPTION OF THE INVENTION

Figure 1:
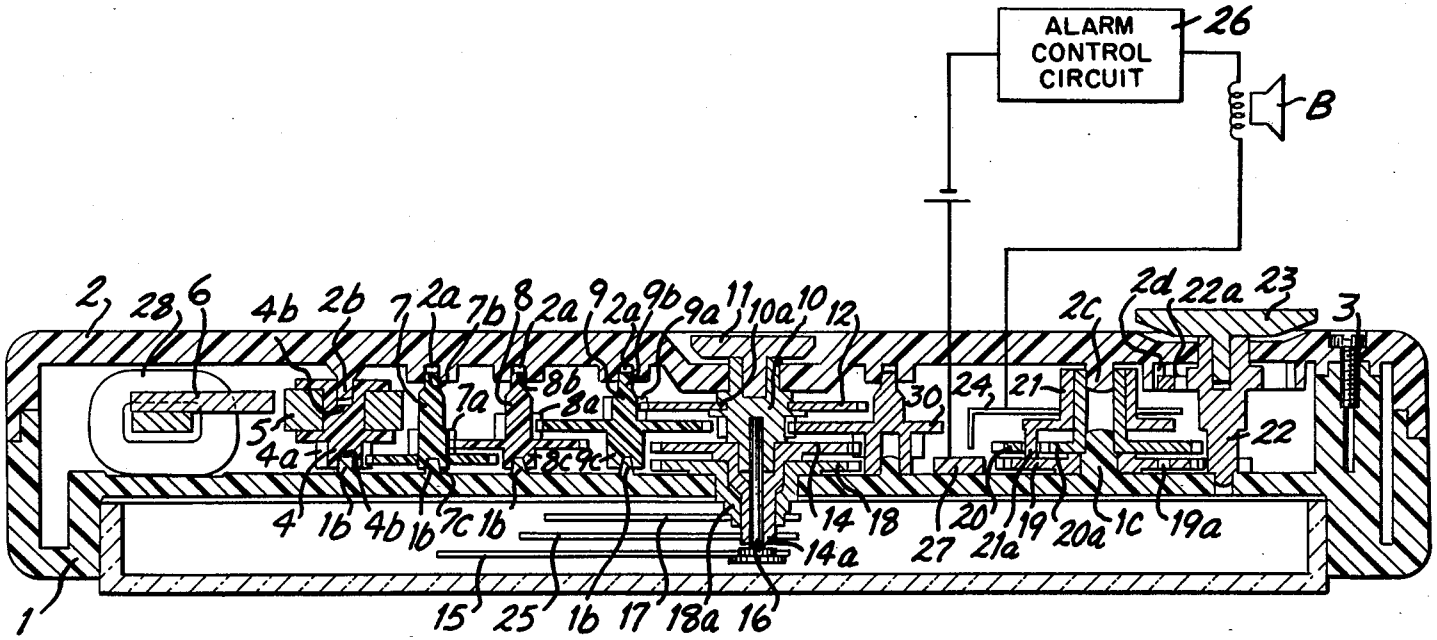
FIG. 1 is a sectional view of a preferred embodiment according to the present invention.
Figure 2:
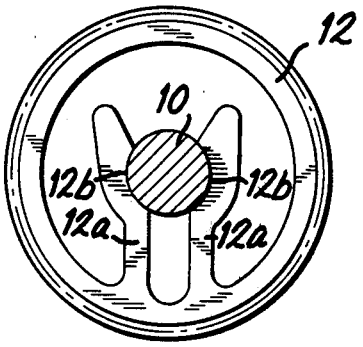
FIG. 2 is a plan view of the slip mechanism of the embodiment of FIG. 1.
Figure 3:
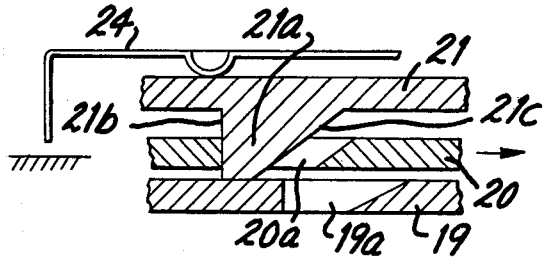
FIG. 3 is a sectional view of the time detecting mechanism of the embodiment of FIG. 1.

Referring first to FIGS. 1 to 3, explanation will be made on the constitution of a preferred embodiment according to the present invention. A top case 1 and a bottom case 2, each formed of a plastic material, are joined together by screws 3. Integral bores 2*a* and pivots 1*b* and 2*b* for rotatably supporting gear wheels are formed on the inner surfaces of the cases 1 and 2. The outer surfaces of the cases 1 and 2 are formed in the appearance of the clock. A rotor core 4 formed of a plastic material has an integral pinion 4*a* and is provided with bores 4*b* on the top and bottom end thereof for receiving the pivots 1*b* and 2*b* respectively. A rotor magnet 5 magnetized in S-pole and N-pole along the surface at equal intervals is secured on the rotor core 4. A stator 6 is magnetized in S-pole and N-pole alternately at equal intervals, for example at five-second intervals, by a coil 28 connected to a crystal oscillation circuit and a frequency dividing circuit, not shown, so that the rotor 4 is intermittently turned in the same direction for an angle of 180° at five-second intervals. A second gear wheel 7, a third gear wheel 8 and a fourth gear wheel 9, all formed of a plastic material, comprise pinions 7*a*, 8*a* and 9*a*, pivots 7*b*, 8*b* and 9*b* which rotatably fit in the bores 2*a* formed on the bottom case 2, and bores 7*c*, 8*c* and 9*c* which rotatably receive the pivots 1*b* formed on the top case 1, respectively. Thus the rotor core 4 and the gear wheels 7, 8 and 9 are supported between the top and bottom cases 1 and 2 for pivotal motion under reduced frictional resistance. The gears and the pinions form a reduction gear train. The combination of the pivots and the bores in the form of a tenon and a mortise, the thickness of the clock can be reduced by the length of the pivots as the pivots fit in the bores formed on the gears, i.e. in the idle space, whereas pivots extending from gears fit in the bores formed on the case in the conventional clocks. One end portion of a minute gear core 10 is rotatably supported by and penetrates through the bottom case 2 and to the end thereof is fixed a minute hand turning knob 11, while the other end portion is rotatably supported by the inner periphery of the pipe 14*a* of of an hour gear wheel 14. A groove 10*a* is formed at the intermediate part of the minute gear core 10. A minute hand shaft 16 carrying the minute hand 15 is force-fit in the minute gear core 10 at the front end thereof. A minute gear wheel 12 engaging with an integral pinion of the fourth gear wheel 9 is provided with two resilient arms 12*a* having arcuate portions 12*b* respectively. The resilient arms 12*a* engages with the groove 10*a* formed on the minute gear core 10, thus the minute gear core 10 and the minute gear wheel 12 constitute a slip mechanism well known as a clock mechanism. The hour gear wheel 14 is engaged with a pinion fixed on the minute gear core 10 through an intermediate hour gear wheel 30.

Figure 4:
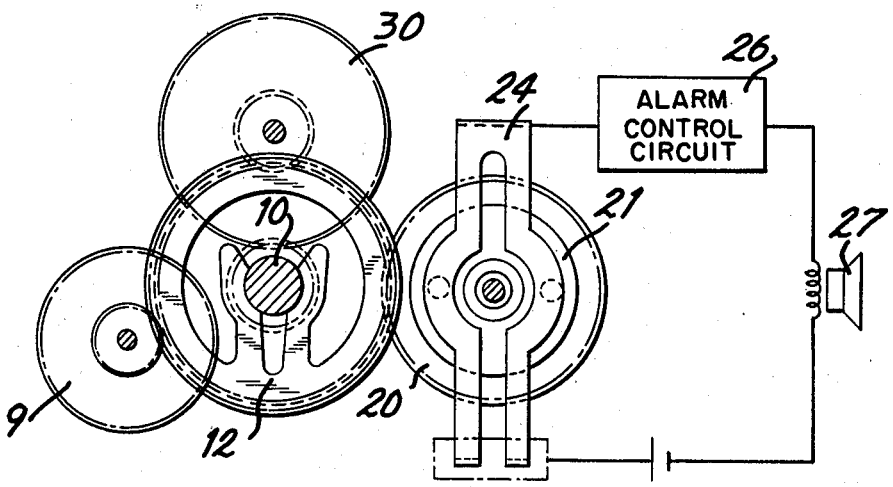
FIG. 4 is a partial plan view of the embodiment of FIG. 1.

As shown in FIGS. 1 and 4, a space corresponding to one line of gears can be reduced by disposing the fourth gear wheel 9 and the intermediate hour gear wheel 30 in the space between the minute gear wheel 12 and the hour gear wheel 14 without interference between the fourth gear wheel 9 and the intermediate hour gear wheel 30. The pipe 14*a* of the hour gear wheel 14 penetrates through the pipe 18*a* of an alarm gear wheel 18 while it is rotatably supported by the inner periphery of the pipe 18*a*. The hour hand 25 is fixed to the front end of the pipe 14*a*. The pipe 18*a* of the alarm gear wheel 18 penetrates through the top case 1 while it is rotatably supported by the top case 1. An alarm time indicating needle 17 is fixed to the front end of the pipe 18*a*. A second alarm gear wheel 19 engaging with the alarm gear wheel 18 is rotatably supported on the pivot 1*c* formed in solid with the top case 1 and provided with two cam holes, each having oppositely formed vertical and inclined walls, and arranged along circles of different radiuses as illustrated in detail in FIG. 3. A second hour gear wheel 20 rotatably supported on pivots 1*c* and 2*c* both formed in solid with the top case 1 and the bottom case 2 respectively, and engaging with the hour gear wheel 14 is disposed above the second alarm gear wheel 19 and provided with two cam holes 20*a* corresponding to the cam holes 19*a* of the second alarm gear wheel 19. Each of the cam holes 20*a* also has oppositely formed vertical and inclined walls as shown in FIG. 3. An alarm cam plate 21 is rotatable and axially slidable on the pipe shaft of the second hour gear wheel 20 and provided with two cams 21*a* corresponding to the cam holes 20*a* of the second hour gear wheel 20 and the cam holes 19*a* of the second alarm gear wheel 19. Normally, the cam 21*a* penetrate through the cam holes 20*a* of the second hour gear wheel 20 and in sliding contact with the surface of the second alarm gear wheel 19. Each cam 21*a* is formed of a vertical face 21*b* and an inclined face 21*c*. An alarm time setting pinion 22 engaging with the second alarm gear wheel 19 is provided with a resilient arm 22*a* engaging with a click 2*d* formed on the bottom case 2 and fixedly provided with an alarm time setting knob 23 bottom end thereof penetrating through the bottom case 2. A detecting switch plate 24 is adapted to be controlled by the alarm cam plate 21. Normally the alarm cam plate 21 retains the switch plate 24 at the open position and when the cams 21*a* drop into the cam holes 19*a* of the second alarm gear wheel 19 releases the switch plate 24 so that the switch plate 24 is allowed to move to the closed position by its inherent spring force. The detecting switch plate 24 is arranged to control the gate of an alarm control circuit 26. When the detecting switch plate 24 move to the closed position, the gate is opened to actuate an alarm device 27.

In addition to the description of the constitution provided hereinbefore, as described in the presentation of the object of the present invention, the gear wheels of the mechanism can be formed in a minimum allowable thickness as the axial shifting of the hour gear wheel, the alarm gear wheel, the second alarm gear wheel and the second hour gear wheel is not necessary, besides the alarm cam plate which is required to move axially can be disposed within a space including the minute gear wheel disposed above the hour gear wheel and the pinion of the minute gear core, thus providing an alarm clock of a minimum possible thickness.

The object of the present invention can be further improved as the axial wiedh of the space can be reduced to a minimum allowable width because the fourth gear wheel, the intermediate hour gear wheel, and the second hour gear wheel or the alarm cam plate can be arranged in axially overlapping disposition only if the gears are prevented from mutual interference in a plane.

It is obvious from what has been described hereinbefore that the present invention is capable of providing small-sized and pocketable clocks as the thickness of the clocks according to the present invnention can be reduced to an extreme minimum.

What is claimed is:

1. In an alarm clock comprising an hour gear wheel for indicating time, an alarm gear wheel for indicating alarm time, and a second hour gear wheel and a second alarm gear wheel engaging with said hour gear wheel and said alarm gear wheel respectively, and adapted to actuate an alarm device in coincidence of the respective phases of said second alarm gear wheel, a time detecting mechanism characterized by provision of an axially shiftable alarm cam plate having a guide face at which said alarm cam plate is continuously pushed and turned by said second hour gear wheel and a projection penetrating through said second hour gear wheel and related with a cavity formed on said second alarm gear wheel for detecting alarm time.

2. A time detecting device as set forth in claim 1, wherein a minute gear wheel, a fourth gear wheel which drives said minute gear wheel, and an intermediate hour gear wheel engaged with said minute gear wheel and adapted to drive said hour gear wheel being provided and at least said fourth gear wheel, said intermediate hour gear wheel and said detecting cam plate being arranged in a plane without mutual interference.

3. A time detecting device as set forth in claim 1, wherein top and bottom cases each formed of a plastic material being provided, pivots (1*b*and 2*b*) being formed in solid with either said top case or said bottom case, and bores (4*b*, 7*c*, 8*c* and 9*c*) being formed on gear wheels rotatably supported by said respective pivots for receiving said respective pivots.

* * * * *